US009056743B2

(12) United States Patent
Sato et al.

(10) Patent No.: US 9,056,743 B2
(45) Date of Patent: Jun. 16, 2015

(54) SHEET PROCESS DEVICE

(71) Applicant: KYOCERA Document Solutions Inc., Osaka (JP)

(72) Inventors: Takehiro Sato, Osaka (JP); Hideaki Doyo, Osaka (JP); Yuichiro Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/457,344

(22) Filed: Aug. 12, 2014

(65) Prior Publication Data

US 2015/0076761 A1 Mar. 19, 2015

(51) Int. Cl.

| | |
|---|---|
| ***B65H 29/12*** | (2006.01) |
| ***B65H 39/00*** | (2006.01) |
| *B65H 7/20* | (2006.01) |

(52) U.S. Cl.

CPC ..... *B65H 29/125* (2013.01); *B65H 7/20* (2013.01); *B65H 2402/10* (2013.01); *B65H 2402/441* (2013.01); *B65H 2404/611* (2013.01); *B65H 2801/27* (2013.01)

(58) Field of Classification Search

CPC ..... B65H 29/125; B65H 2402/10; B65H 2402/441; B65H 2801/27; B65H 2404/611

USPC ..... 271/302, 189; 399/110

See application file for complete search history.

(56) References Cited

U.S. PATENT DOCUMENTS

| | | | | |
|---|---|---|---|---|
| 6,634,640 | B1 * | 10/2003 | Yoshizawa et al. | 271/213 |
| 8,454,014 | B2 * | 6/2013 | Kotera | 271/273 |
| 8,794,616 | B2 * | 8/2014 | Matsuki et al. | 270/58.07 |
| 2007/0085257 | A1 * | 4/2007 | Kang | 270/58.07 |
| 2009/0194939 | A1 * | 8/2009 | Matsushima | 271/278 |
| 2009/0196635 | A1 * | 8/2009 | Morita | 399/21 |
| 2013/0009357 | A1 * | 1/2013 | Takimoto | 271/225 |
| 2013/0049279 | A1 * | 2/2013 | Nagata | 270/58.07 |
| 2014/0151955 | A1 * | 6/2014 | Yoshida | 271/184 |
| 2014/0368848 | A1 * | 12/2014 | Takata | 358/1.12 |
| 2015/0028540 | A1 * | 1/2015 | Shibasaki et al. | 271/306 |

FOREIGN PATENT DOCUMENTS

JP 2011-195277 A 10/2011

* cited by examiner

*Primary Examiner* — Patrick Cicchino

(74) *Attorney, Agent, or Firm* — Studebaker & Brackett PC

(57) ABSTRACT

A sheet process device includes a supporting member and a process device main body. The supporting member is attached to the lateral face at a side of an in-body sheet ejection space of an image forming apparatus. The process device main body is supported by the supporting member. The process device main body includes a relay conveyance unit and a post process unit. The relay conveyance unit is arranged slidable in a direction to the in-body sheet ejection space. The post process unit is arranged slidable in upward and downward directions with respect to the supporting member. The process device main body provides a sheet conveying path extending from a sheet ejection port of the image forming apparatus to the post process unit through the relay conveyance unit, when the post process unit is moved upwardly after the relay conveyance unit is moved into the in-body sheet ejection space.

6 Claims, 5 Drawing Sheets

SHEET PROCESS DEVICE

INCORPORATION BY REFERENCE

This application is based on and claims the benefit of priority from Japanese Patent application No. 2013-192546 filed on Sep. 18, 2013, the entire contents of which are incorporated herein by reference.

BACKGROUND

The present disclosure relates to a sheet process device carrying out post processes (punch process, staple process, sorting process and others) for a sheet ejected from an image forming apparatus including an in-body sheet ejection part.

As a general image forming apparatus, there is a type of arranging an in-body sheet ejection space between an upper image reading part and a lower image forming part, and then, the sheet ejected from the image forming part is received by a tray formed in a bottom face surrounding the in-body sheet ejection space. Such an image forming apparatus of the in-body sheet ejection type has the advantage of making an occupation area narrow because an ejection tray is not protruded from the lateral side of the image forming apparatus in the lateral direction.

When a sheet process device performing post processes for a sheet is attached to the image forming apparatus of the in-body sheet ejection type as mentioned above, because the in-body sheet ejection space does not have a volume capable of containing the sheet process device, the sheet process device is often attached to the lateral face of the image forming apparatus. In such a case, it is necessary to convey the sheet ejected from the image forming part through the in-body sheet ejection space to the sheet process device. Therefore, in the in-body sheet ejection space, a relay conveyance unit conveying the sheet from a sheet ejection port of the image forming apparatus to a sheet reception port of the sheet process device may be arranged.

However, in a case where the relay conveyance unit is arranged, because it is necessary to separately install the sheet process device and relay conveyance unit to the image forming apparatus, there is a problem that labor and time are taken. Moreover, because positioning of the sheet process device and relay conveyance unit is difficult, if a difference or a gap is caused between the sheet ejection port of the image forming apparatus and the sheet reception port of the sheet process device, there is a possibility of occurring conveyance failure, such as paper jam.

SUMMARY

In accordance with an embodiment of the present disclosure, a sheet process device includes a supporting member and a process device main body. The supporting member is attached to the lateral face at a side of an in-body sheet ejection space of an image forming apparatus. The process device main body is supported by the supporting member. The process device main body includes a relay conveyance unit and a post process unit. The relay conveyance unit is arranged slidable in a direction to the in-body sheet ejection space of the image forming apparatus. The post process unit is arranged slidable in upward and downward directions with respect to the supporting member. The process device main body provides a sheet conveying path extending from a sheet ejection port of the image forming apparatus to the post process unit through the relay conveyance unit, when the post process unit is moved upwardly after the relay conveyance unit is moved into the in-body sheet ejection space.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 4A illustrates a condition where a supporting member of the sheet process device is attached to the image forming apparatus, FIG. 4B illustrates a condition where a relay conveyance unit is advanced into an in-body sheet ejection space, and FIG. 4C illustrates a condition where a post process unit is lifted up.

FIG. 5A illustrates a condition where the sheet process device is installed to the image forming apparatus, FIG. 5B illustrates a condition where the post process unit is lowered, and FIG. 5C illustrates a condition where the relay conveyance unit is withdrawn from the in-body sheet ejection space.

DETAILED DESCRIPTION

In the following, with reference the drawings, a sheet process device according to an embodiment of the present disclosure will be described.

Figure 1:
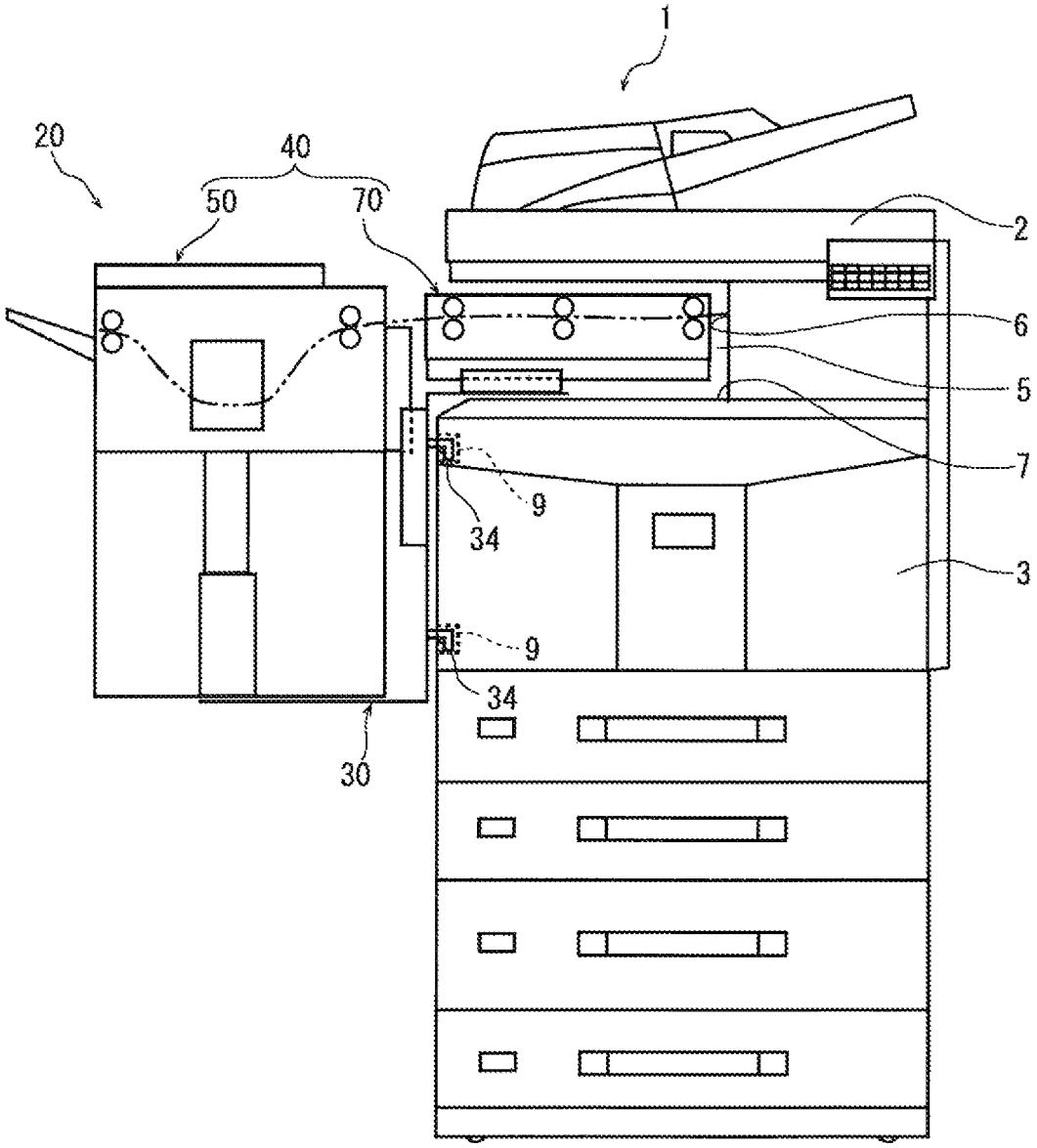
FIG. 1 is a front view schematically showing a sheet process device, in a condition of being connected to an image forming apparatus, according to an embodiment of the present disclosure.
Figure 2:
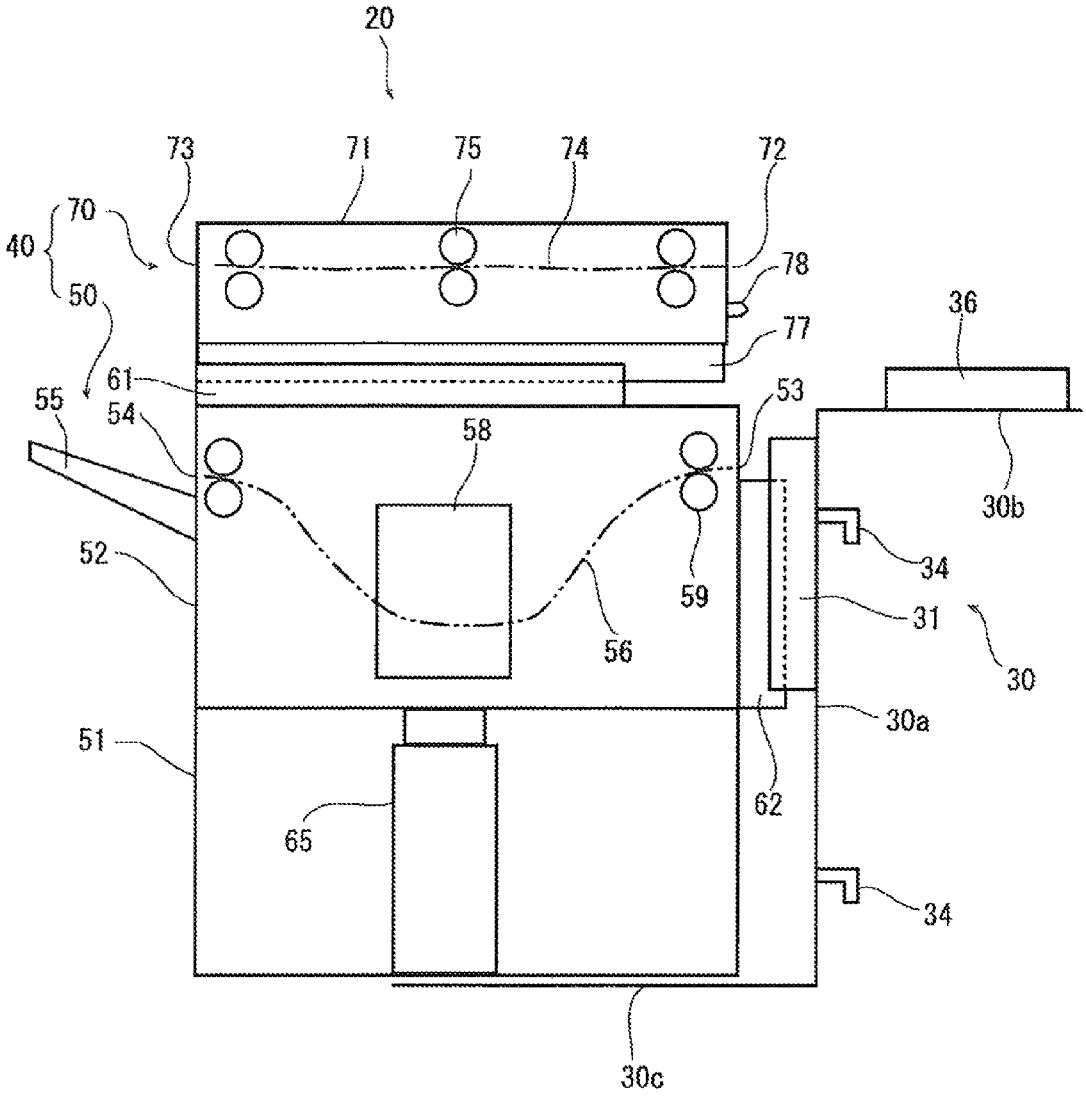
FIG. 2 is a front view schematically showing an internal structure of the sheet process device according to the embodiment of the present disclosure.
Figure 3:
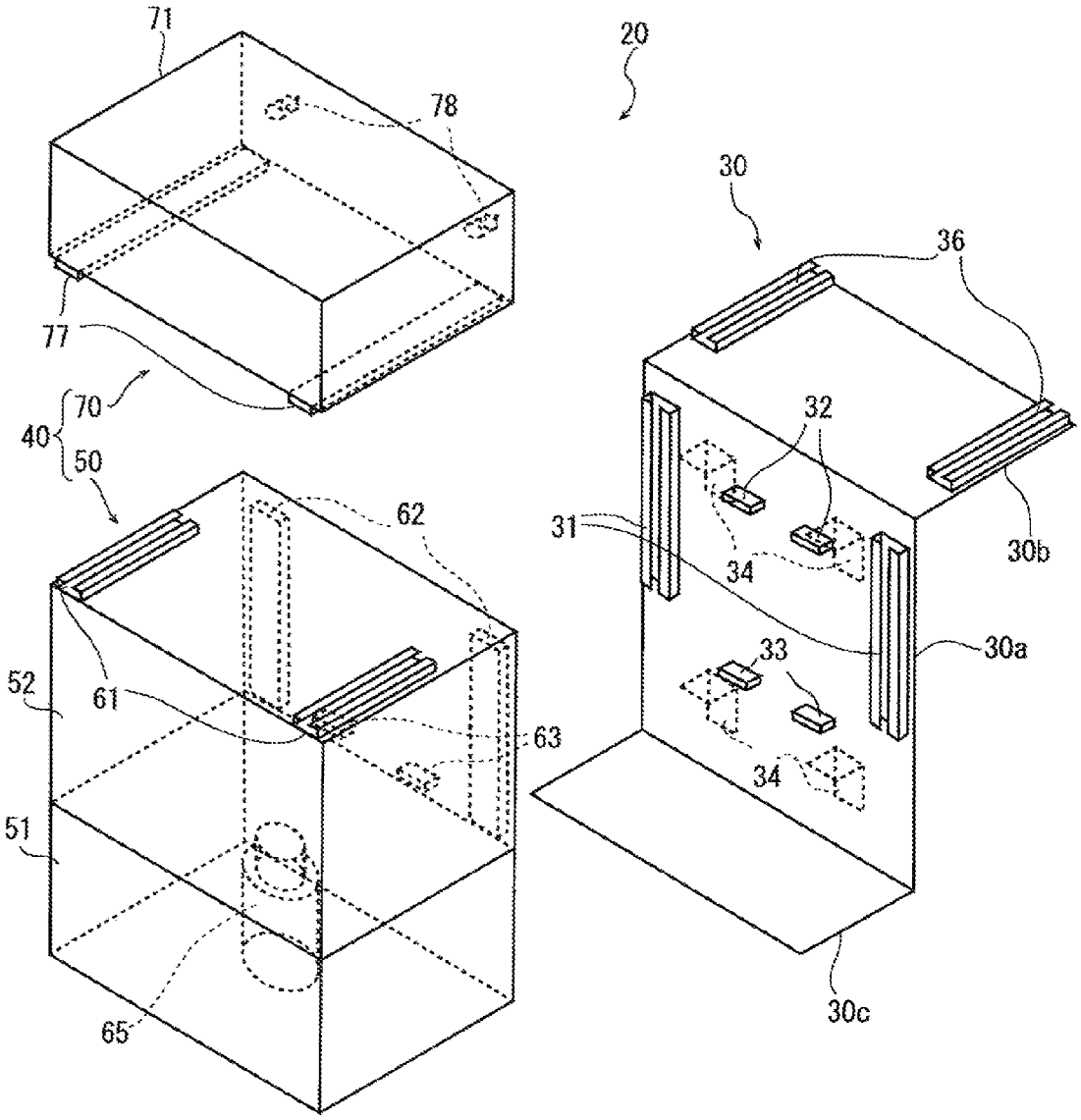
FIG. 3 is an exploded perspective view schematically showing an entire structure of the sheet process device according to the embodiment of the present disclosure.

With reference to FIGS. 1 to 3, the sheet process device according to the embodiment of the present disclosure will be described. FIG. 1 is a front view schematically showing the sheet process device, in a condition of being connected to an image forming apparatus. FIG. 2 is a front view schematically showing an internal structure of the sheet process device. FIG. 3 is an exploded perspective view schematically showing an entire structure of the sheet process device. In the following description, the front side of a paper plane of FIG. 1 indicates the front side of the sheet process device and image forming apparatus and an orthogonal direction to the forward and backward directions as viewed from the front side indicates left and right directions.

First, with reference to FIG. 1, the image forming apparatus will be described. The image forming apparatus 1 includes an image reading part 2 arranged in an upper part and an image forming part 3 arranged in a lower part. Between the image reading part 2 and image forming part 3, an in-body sheet ejection space 5 is arranged. A left side face surrounding the in-body sheet ejection space 5 in the image forming apparatus 1 is opened. In a right side face surrounding the in-body sheet ejection space 5 in the image forming apparatus 1, a sheet ejecting port 6 is arranged to eject a sheet having an image formed by the image forming apparatus 1. In a bottom face surrounding the in-body sheet ejection space 5 in the image forming apparatus 1, a tray 7 is formed to receive the sheet ejected from the sheet ejecting port 6.

On an upper portion and a lower portion of a left lateral face of the image forming part 3, hook engaging parts 9 arranged in forward and backward directions are formed below the in-body sheet ejection space 5.

Next, with reference to FIGS. 2 and 3, the sheet process device 20 will be described. The sheet process device 20 includes a supporting member 30 attached to the left lateral face of the image forming apparatus 1 and a process device main body 40 supported by the supporting member 30.

The supporting member 30 is a sheet metal member formed in a roughly Z-shape as viewed from the front side. The supporting member 30 includes a central vertical plate part 30*a*, an upper plate part 30*b* and a lower plate part 30*c*. The upper plate part 30*b* is bent from an upper end of the vertical plate part 30*a* to the right direction at roughly right angles. The lower plate part 30*c* is bent from a lower end of the vertical plate part 30*a* to the left direction at roughly right angles. The supporting member 30 is arranged so that the vertical plate part 30*a* faces to the left lateral face of the image forming apparatus 1 and the upper plate part 30*b* faces to the tray 7 of the in-body sheet ejection space 5.

On a left face of the vertical plate part 30*a*, two parallel rails 31 (longitudinal guiding parts) extending in upward and downward directions are arranged along front and rear edges. On an upper portion and a lower portion of the left face of the vertical plate 30*a*, upper engagingly stopping protrusions 32 and lower engagingly stopping protrusions 33 are formed arranging in the forward and backward directions respectively (refer to FIG. 3). On an upper portion and a lower portion of a right face of the vertical plate part 30*a*, hook parts 34 are formed arranging in the forward and backward directions.

On a top face of the upper plate part 30*b*, two parallel rails 36 (supporting member side lateral guiding parts) extending in the left and right directions are arranged along front and rear edges.

The process device main body 40 includes a post process unit 50 and a relay conveyance unit 70. The post process unit 50 performs post processes for the sheet. The relay conveyance unit 70 is arranged above the post process unit 50 to convey the sheet.

The post process unit 50 is formed in a rectangular parallelepiped shape elongated in the upward and downward directions. The post process unit 50 includes a lower housing 51 and an upper housing 52. The upper housing 52 is formed so as to move between an upper limit position and a lower limit position in the upward and downward directions with respect to the lower housing 51.

As shown in FIG. 2, the upper housing 52 is formed with a sheet reception port 53 in the right face and a sheet ejection port 54 in the left face. Below the sheet ejection port 54, an ejected sheet tray 55 is arranged. Inside the upper housing 52, a sheet conveying path 56 extending from the sheet reception port 53 to the sheet ejection port 54 is arranged. In the middle of the sheet conveying path 56, a post process part 58 performing the post processes (punch process, staple process and others) for the sheet is arranged. Along the sheet conveying path 56, a plurality of conveying rollers 59 composed of pairs of upper and lower rollers are arranged.

On a top face of the upper housing 52, two parallel rails 61 (lateral guiding parts) extending in the left and right directions are arranged along front and rear edges. The rails 61 are formed so as to have positions and shapes corresponding to the rails 36 arranged in the upper plate part 30*b* of the supporting member 30. In left ends of the rails 61, stoppers (not shown) are arranged. On a right face of the upper housing 52, two parallel sliders 62 (longitudinal guided parts) extending in the upward and downward directions are arranged along front and rear edges. The sliders 62 are configured so as to engage with the rails 31 arranged in the vertical plate part 30*a* of the supporting member 30.

As shown in FIG. 3, on a lower portion of the right face of the upper housing 52, engagingly stopping parts 63 protruded in the lateral direction are formed. The engagingly stopping parts 63 are configured so as to be engagingly stopped to the upper engagingly stopping protrusions 32 and lower engagingly stopping protrusions arranged in the vertical plate part 30*a* of the supporting member 30. The upper housing 52 is moved between the upper limit position, where the engagingly stopping parts 63 come into contact with the upper engagingly stopping protrusions 32, and the lower limit position, where the engagingly stopping parts 63 come into contact with the lower engagingly stopping protrusions 33, in the upward and downward directions with respect to the lower housing 51.

In the upper housing 52 and lower housing 51, upper holding parts (not shown) and lower holding parts (not shown) are formed. The upper holding parts locks the upper housing 52 to the lower housing 51 at the upper limit position where the engagingly stopping parts 63 are engagingly stopped to the upper engagingly stopping protrusions 32. The lower engagingly stopping parts locks the upper housing 52 to the lower housing 51 at the lower limit position where the engagingly stopping parts 63 are engagingly stopped to the lower engagingly stopping protrusions 33. In transportation or storage, the upper housing 52 and lower housing 51 are locked by the lower holding parts.

Between the upper housing 52 and lower housing 51, an oil damper 65 (a biasing member) is interposed. The oil damper 65 biases the upper housing 52 to the upper limit position with respect to the lower housing 51.

The relay conveyance unit 70 includes a housing 71 formed in a flat rectangular parallelepiped shape being thin in the upward and downward directions. As shown in FIG. 2, the housing 71 is formed with a sheet reception port 72 in the right face and a sheet ejection port 73 in the left face. Inside the housing 71, a sheet conveying path 74 extending from the sheet reception port 72 to the sheet ejection port 73 is arranged. Along the sheet conveying path 74, a plurality of conveying rollers 75 composed of pairs of upper and lower rollers are arranged.

On a lower face of the housing 71, two parallel sliders 77 (lateral guided parts) extending in the left and right directions are arranged along front and rear edges. The sliders 77 are engaged with the rails 61 arranged in the upper housing 52 of the post process unit 50, and accordingly, the relay conveyance unit 70 is connected to the post process unit 50. The sheet ejection port 73 is formed at a position as corresponding to the sheet reception port 53 of the upper housing 52 of the post process unit 50.

In the housing 71 of the relay conveyance unit 70 and the upper housing 52 of the post process unit 50, origin position holding parts (not shown) are formed. The origin position holding parts locks the housing 71 to the upper housing 52 at an origin position where the housing 71 comes into contact with the stoppers arranged at the left ends of the rails 61 of the upper housing 52. In transportation or storage, the housing 71 of the relay conveyance unit 70 is locked to the upper housing 52 of the post process unit 50 at the origin position by the origin position holding parts.

The sliders 77 arranged on the lower face of the housing 71 are engaged with the rails 36 arranged in the upper plate part 30*b* of the supporting member 30.

In the right face of the housing 71, positioning pins 78 positioning the housing 71 to the image forming apparatus 1 and a connecter (not shown) electrically connecting the housing 71 to the image forming apparatus 1 are arranged.

In the sheet process device 20, the process device main body 40 configured as mentioned above is attached to the supporting member 30 so that the lower housing 51 of the post process unit 50 is supported by a top face of the lower plate part 30*c* of the supporting member 30 and the sliders 62 of the upper housing 52 are engaged with the rails 31 of the vertical plate part 30*a* of the supporting member 30.

Figure 4A:
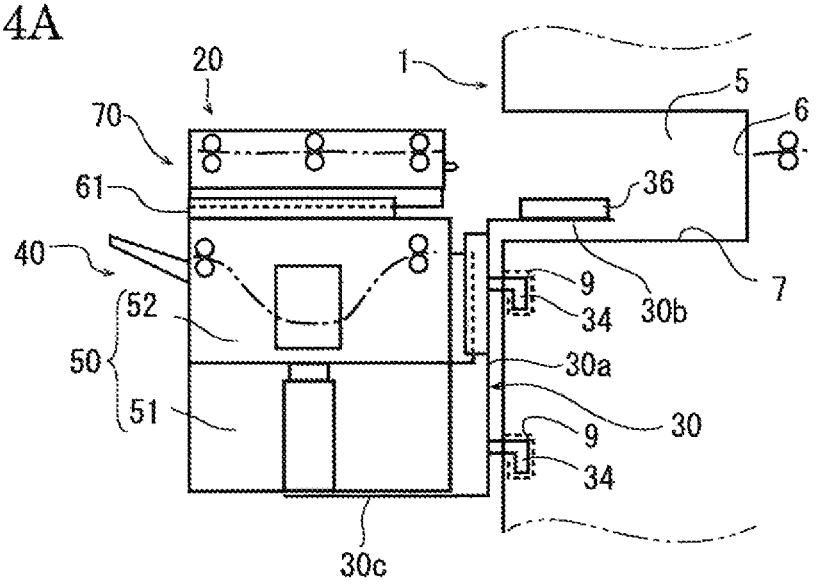
FIGS. 4A to 4C are front views schematically showing the sheet process device together with the periphery, useful for understanding a manner of connecting the sheet process device to the image forming apparatus, according to the embodiment of the present disclosure.
Figure 4B:
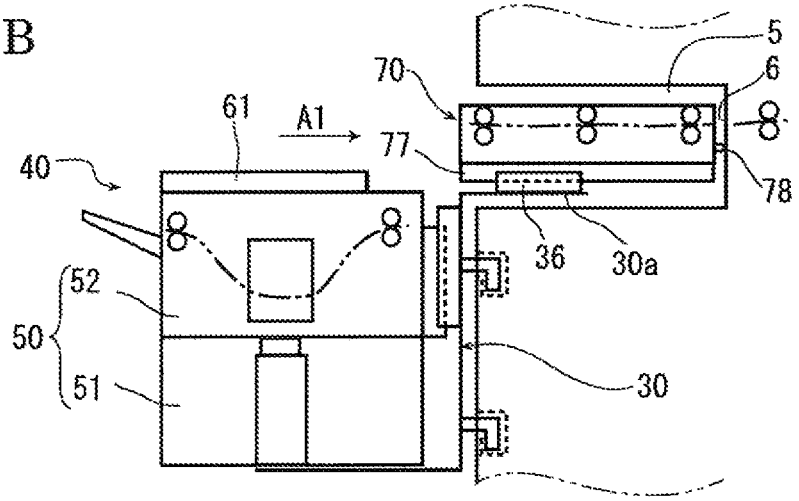
Figure 4C:
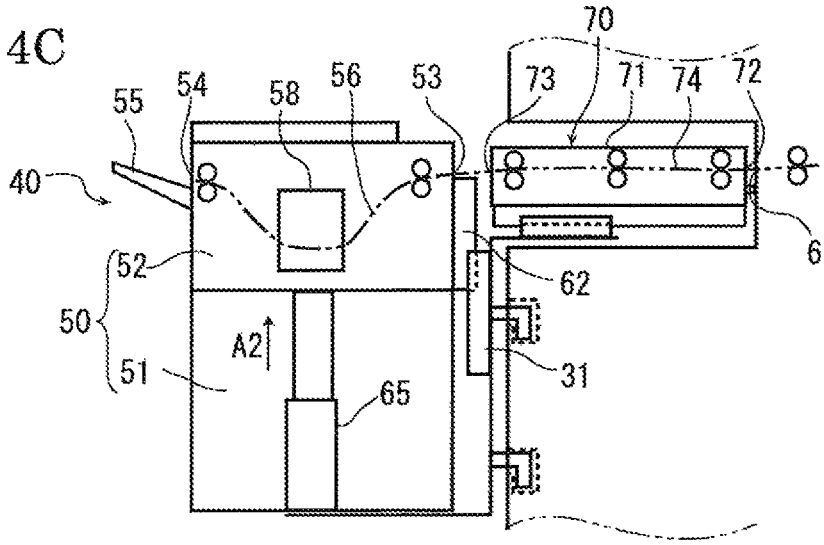

A manner of connecting the sheet process device 20 with the above-mentioned configuration to the image forming apparatus 1 will be described with reference to FIGS. 4A to 4C. FIGS. 4A to 4C are front views schematically showing the sheet process device 20 together with the periphery, useful for understanding the manner of connecting the sheet process device 20 to the image forming apparatus 1. FIG. 4A illustrates a condition where the supporting member 30 is attached to the image forming apparatus 1, FIG. 4B illustrates a condition where the relay conveyance unit 70 is advanced into the in-body sheet ejection space 5, and FIG. 4C illustrates a condition where the post process unit 50 is lifted up.

When the sheet process device 20 is attached to the image forming apparatus 1, as shown in FIG. 4A, the hooks 34 formed on the right face of the vertical plate part 30*a* of the supporting member 30 supporting the process device main body 40 are engaged with the hook engaging parts 9 formed in the left lateral face of the image forming apparatus 1. Subsequently, the vertical plate part 30*a* is fastened to the left lateral face of the image forming apparatus 1 by screws. Thereby, the process device main body 40 is located on the left lateral face of the image forming apparatus 1 and the upper plate part 30*b* of the supporting member 30 overhangs the tray 7 in the in-body sheet ejection space 5 of the image forming apparatus 1.

In the post process unit 50 of the process device main body 40, the upper housing 52 is locked to the lower housing 51 at the lower limit position by the lower holding parts. When the upper housing 52 is in the lower limit position, the rails 61 arranged on the top face of the upper housing 52 are positioned at the same level as the rails 36 arranged in the upper plate part 30*b* of the supporting member 30.

Next, the lock of the origin position holding parts locking the housing 71 of the relay conveyance unit 70 to the upper housing 52 of the post process unit 50 is released. Thereby, the relay conveyance unit 70 becomes slidable in the right direction. As indicated by an arrow A1 in FIG. 4B, when the relay conveyance unit 70 is pushed in the right direction, the relay conveyance unit 70 is slid toward the in-body sheet ejection space 5 along the rails 61 arranged on the top face of the upper housing 52 of the post process unit 50. Subsequently, the relay conveyance unit 70 is inserted in the in-body sheet ejection space 5, and then, shifted to the rails 36 arranged in the upper plate part 30*b* of the supporting member 30 and slid to the sheet ejection port 6 along the rails 36 inside the in-body sheet ejection space 5. The relay conveyance unit 70 is advanced until the positioning pins 78 formed on the right face come into contact with positioning parts (not shown) formed near the sheet ejection port 6 of the image forming apparatus 1. In such a condition, the relay conveyance unit 70 and image forming apparatus 1 are locked by advance limit holding parts (not shown).

Then, when the lock of the upper housing 52 and lower housing 51 of the post process unit 50 by the lower holding parts is released, as indicated by an arrow A2 in FIG. 4C, the upper housing 52 is biased by the oil damper 65 and automatically lifted up along the rails 31 arranged in the vertical plate part 30*a* of the supporting member 30. After the upper housing 52 is lifted up to the upper limit position, the upper housing 52 is locked to the lower housing 51 by the upper holding parts. When the upper housing 52 is in the upper limit position, the sheet reception port 53 of the upper housing 52 is positioned at the same level as the sheet ejection port 73 of the housing 71 of the relay conveyance unit 70 advanced into the in-body sheet ejection space 5 of the image forming apparatus 1.

As a result, as shown in FIG. 4C, a serial conveying path is provided so as to begin with the sheet ejection port 6 of the image forming apparatus 1, to enter the sheet reception port 72 of the housing 71 of the relay conveyance unit 70, to pass through the conveying path 74, to exit from the sheet ejection port 73, to enter the sheet reception port 53 of the upper housing 52 of the post process unit 50, to pass through the conveying path 56 and to lead to the sheet ejection port 54. The sheet is conveyed along this conveying path, the post processes for the sheet are performed by the post process part 58 of the upper housing 52 of the post process unit 50, and then, the sheet is ejected to the ejected sheet tray 55.

Figure 5A:
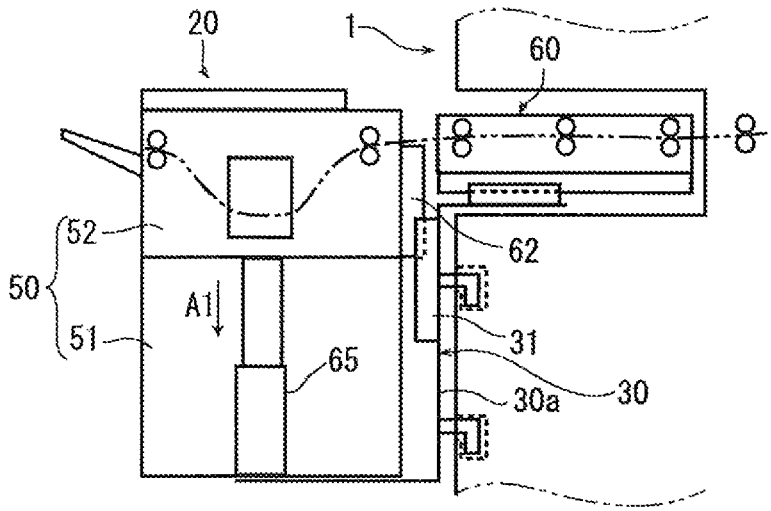
FIGS. 5A to 5C are front views schematically showing the sheet process device together with the periphery, useful for understanding a manner of removing the sheet process device from the image forming apparatus, according to the embodiment of the present disclosure.
Figure 5B:
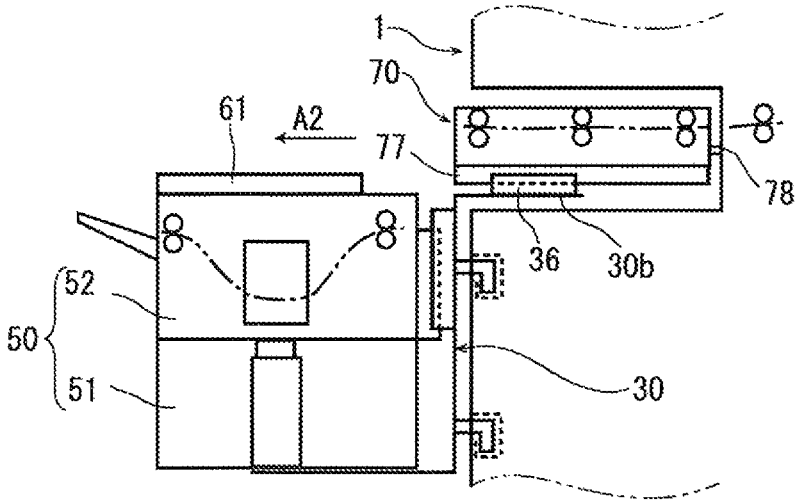
Figure 5C:
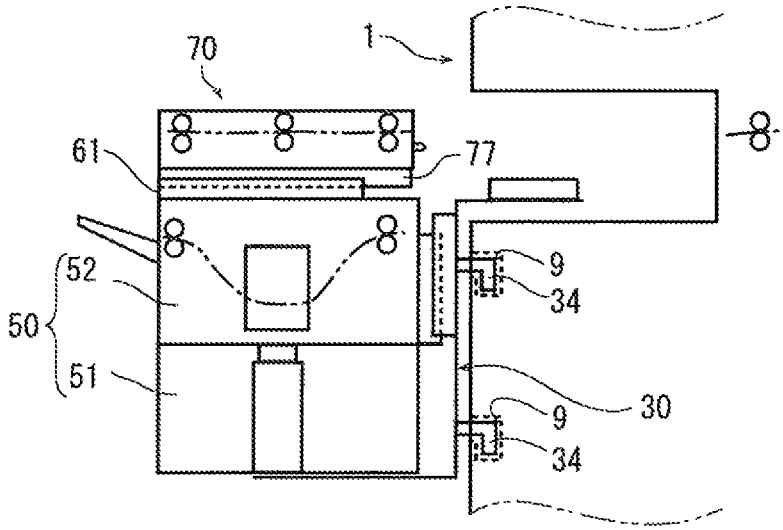

A manner of removing the sheet process device 20 from the image forming apparatus 1 will be described with reference to FIGS. 5A to 5C. FIGS. 5A to 5C are front views schematically showing the sheet process device 20 together with the periphery, useful for understanding the manner of removing the sheet process device 20 from the image forming apparatus 1. FIG. 5A illustrates a condition where the sheet process device 20 is installed to the image forming apparatus 1, FIG. 5B illustrates a condition where the post process unit 50 is lowered, and FIG. 5C illustrates a condition where the relay conveyance unit 70 is withdrawn from the in-body sheet ejection space 5.

Under the condition illustrated in FIG. 5A, where the sheet process device 20 is installed to the image forming apparatus 1, first, in the post process unit 50, the lock of the upper housing 52 to the lower housing 51 at the upper limit position by the upper holding parts is released, and then, as indicated by an arrow A1, the upper housing 52 is pushed down against biasing force of the oil damper 65. The upper housing 52 is slid along the rails arranged in the vertical plate part 30*a* of the supporting member 30 and lowered to the lower limit position. Subsequently, the upper housing 52 and lower housing 51 are locked by the lower holding parts.

Next, the lock of the relay conveyance unit 70 and image forming apparatus 1 by the advance limit holding parts is released, and then, as indicated by an arrow A2 in FIG. 5B, the relay conveyance unit 70 is pulled back in the left direction. As shown in FIG. 5C, the relay conveyance unit 70 is shifted from the rails 36 arranged in the upper plate part 30*b* of the supporting member 30 to the rails 61 arranged on the upper housing 52 of the post process unit 50 and withdrawn toward the upper face of the upper housing 52. After the relay conveyance unit 70 is slid until the sliders 77 is engagingly stopped to the stoppers of the rails 61 arranged in the upper housing 52, the relay conveyance unit 70 is locked to the upper housing 52 of the post process unit 50 by the origin position holding parts.

Finally, after the screws fastening the vertical plate part 30*a* of the supporting member 30 to the left lateral face of the image forming apparatus 1 are removed, the hook parts 34 of the supporting member 30 are removed from the hook engaging parts 9 of the image forming apparatus 1 and then the supporting member 30 supporting the process device main body 40 is separated from the image forming apparatus 1.

Incidentally, when paper jam occurs in the sheet process device 20, if the paper jam position is in the post process unit 50, the paper jam is handled in the condition as shown in FIG. 5A where the sheet process device 20 is connected to the image forming apparatus 1. On the other hand, if the paper jam position is in the relay conveyance unit 70, the paper jam is handled in the condition as shown in FIG. 5C where the relay conveyance unit 70 is withdrawn from the in-body sheet ejection space after the upper housing 52 is lowered in the post process unit 50.

As described above, in accordance with the sheet process device 20 according to the embodiment of the present disclosure, since the post process unit 50 and relay conveyance unit 70 are integrated, it is possible to install the sheet process device 20 to the image forming apparatus 1 by a series of simple work. Further, since the sheet process device 20 has a roughly rectangular parallelepiped compact shape in an independent state, handling performance is improved, and then, handling in transportation is facilitated and storage space can be reduced.

Moreover, since the post process unit 50 and relay conveyance unit 70 are mechanically positioned by engaging of the rail and slider as well as engaging of the engagingly stopping protrusion and engaging part, it is possible to connect the sheet ejection port 73 of the housing 71 of the relay conveyance unit 70 and the sheet reception port 53 of the upper housing 52 of the post process unit 50 without differences in the upward and downward directions and the left and right directions. Therefore, it is possible to smoothly convey the sheet from the relay conveyance unit 70 to the post process unit 50.

When the relay conveyance unit 70 is advanced into the in-body sheet ejection space 5 of the image forming apparatus 1, since the relay conveyance unit 70 is slid along the rails 61 of the post process unit 50 and then the rails 36 of the supporting member 30 by pushing, it is possible to move the relay conveyance unit 70 by small force. In the post process unit 50, when the upper housing 52 is lifted up with respect to the lower housing 51, since the upper housing 52 is biased upwardly by the oil damper 65, the lifting requires no force. Incidentally, instead of the oil damper 65, a coil spring or the like may be used.

In the embodiment, the advance and withdrawal limits of the relay conveyance unit 70 and the upper and lower limits of the upper housing 52 are determined by mechanical structure, such as the stopper and engagingly stopping part. However, in another embodiment, the determination may be actualized by electrical structure, such as an optical sensor.

Although, in the embodiment, a case of arranging the relay conveyance unit 70 on the top face of the post process unit 50 was described, in another embodiment, the relay conveyance unit 70 may be arranged on a lower face of the post process unit 50. In such a case, the supporting member 30 may be attached to the lateral face of the image forming apparatus 1 above the in-body sheet ejection space 5.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A sheet process device comprising:

a supporting member attached to the lateral face at a side of an in-body sheet ejection space of an image forming apparatus; and a process device main body supported by the supporting member, wherein the process device main body includes:

a relay conveyance unit arranged slidable in a direction to the in-body sheet ejection space of the image forming apparatus; and a post process unit arranged slidable in upward and downward directions with respect to the supporting member, the process device main body provides a sheet conveying path extending from a sheet ejection port of the image forming apparatus to the post process unit through the relay conveyance unit, when the post process unit is moved upwardly after the relay conveyance unit is moved into the in-body sheet ejection space.

2. The sheet process device according to claim 1, wherein the post process unit has a top face, on which a lateral guiding part extending in the direction to the in-body sheet ejection space of the image forming apparatus is formed, the relay conveyance unit has a lower face, on which a lateral guided part guided by the lateral guiding part is formed.

3. The sheet process device according to claim 2, wherein the supporting member has an upper plate part arranged on a bottom face surrounding the in-body sheet ejection space, the upper plate part has a supporting member side lateral guiding part guiding the lateral guided part formed on the lower face of the relay conveyance unit.

4. The sheet process device according to claim 1, wherein the supporting member has a longitudinal guiding part extending in the upward and downward directions, the post process unit has a longitudinal guided part guided by the longitudinal guiding part, the process device main body has a biasing member arranged between the supporting member and post process unit to bias upwardly the post process unit, and the post process unit is biased upwardly along the longitudinal guiding part by the biasing member.

5. The sheet process device according to claim 4, wherein the post process unit includes an upper housing containing a post process part and a lower housing holding the upper housing movable in the upward and downward directions and being supported by the supporting member, the upper housing has the lateral guiding part, the biasing member is arranged between the upper housing and lower housing.

6. The sheet process device according to claim 5, wherein in the post process unit, the upper housing is configured so as to be positioned at a lower limit position or an upper limit position with respect to the lower housing, the upper housing is locked to the lower housing against biasing force of the biasing member when being in the lower limit position, and then, the lateral guiding part formed on a top face of the upper housing is positioned at the same level as the supporting member side lateral guiding part formed in the upper plate part of the supporting member, the upper housing is biased upwardly by the biasing member when being in the upper limit position, and then, the sheet conveying path is provided between the relay conveyance unit moved into the in-body sheet ejection space and the upper housing.

* * * * *